US009663267B2

(12) United States Patent
Love

(10) Patent No.: US 9,663,267 B2
(45) Date of Patent: May 30, 2017

(54) SHIPPING PALLET APPARATUS AND METHOD

(71) Applicant: IntraLoque Licensing Group, Inc., Plymouth, MN (US)

(72) Inventor: David Michael Love, Salt Lake City, UT (US)

(73) Assignee: INTRALOQUE LICENSING GROUP, INC., Plymouth, MN (US)

( * ) Notice: Subject to any disclaimer, the term of this patent is extended or adjusted under 35 U.S.C. 154(b) by 835 days.

(21) Appl. No.: 13/659,769

(22) Filed: Oct. 24, 2012

(65) Prior Publication Data

US 2013/0047897 A1 Feb. 28, 2013

Related U.S. Application Data

(63) Continuation of application No. 12/373,679, filed as application No. PCT/US2007/002403 on Jan. 29, 2007, now abandoned.

(Continued)

(51) Int. Cl.
*B65D 19/00* (2006.01)
*B31D 3/00* (2017.01)

(52) U.S. Cl.
CPC ..... *B65D 19/0022* (2013.01); *B31D 3/002* (2013.01); *B65D 19/0069* (2013.01); *B65D 2519/00019* (2013.01); *B65D 2519/00054* (2013.01); *B65D 2519/00089* (2013.01); *B65D 2519/00134* (2013.01); *B65D 2519/00293* (2013.01); *B65D 2519/00298* (2013.01); *B65D 2519/00303* (2013.01); *B65D 2519/00323* (2013.01); *B65D 2519/00338* (2013.01); *B65D 2519/00343* (2013.01); *B65D 2519/00358* (2013.01); *B65D 2519/00373* (2013.01);

(Continued)

(58) Field of Classification Search
USPC ..... 108/51.2, 56.3, 56.1, 57.17, 57.18
See application file for complete search history.

(56) References Cited

U.S. PATENT DOCUMENTS 2,503,022 A 4/1950 Benoist et al.
3,661,099 A 5/1972 Shelor (Continued)

FOREIGN PATENT DOCUMENTS

DE 44 05 169 A1 8/1995
EP 0 629 557 A1 12/1994
WO WO 01/60700 A2 8/2001

OTHER PUBLICATIONS

Fibre Box Association, What is Corrugated?, website, www.fibrebos.org/info/WhatisCorrugated.aspx, pp. 1-2, Elk Grove Village, IL 60007.

(Continued)

*Primary Examiner* — Andrew Roersma
(74) *Attorney, Agent, or Firm* — Mark A. Litman & Associates, P.A.

(57) ABSTRACT

Shipping pallets 10 that may be constructed, at least in part, from structural members 100 that are largely fabricated from paper and paper based materials are disclosed. One or more of the structural members 100 may include a wrapper 60 secured in tension to a core 20. The core 20 may include one or more laminated fiberboard sheets 40. Because of the use of paper and paper based materials, the one or more aspects of shipping pallets 10 in accordance with the present inventions may be recycled.

7 Claims, 7 Drawing Sheets

Related U.S. Application Data

(60) Provisional application No. 60/830,274, filed on Jul. 13, 2006.

(52) U.S. Cl.
CPC ..... *B65D 2519/00388* (2013.01); *B65D 2519/00437* (2013.01); *B65D 2519/00442* (2013.01); *B65D 2519/00447* (2013.01); *B65D 2519/00562* (2013.01); *B65D 2519/00572* (2013.01)

(56) References Cited

U.S. PATENT DOCUMENTS

| | | | |
|---|---|---|---|
| 4,509,432 | A | 4/1985 | Win |
| 4,802,588 | A | 2/1989 | Silvola |
| 5,042,396 | A | 8/1991 | Shuert |
| 5,269,219 | A | 12/1993 | Juvik-Woods |
| 5,372,570 | A | 12/1994 | Schmidtke et al. |
| 5,413,823 | A | 5/1995 | Lo Presti et al. |
| 5,435,954 | A | 7/1995 | Wold |
| 5,465,672 | A | 11/1995 | Boyse et al. |
| 5,531,166 | A | 7/1996 | Woods et al. |
| 5,537,936 | A | 7/1996 | Cordrey |
| 5,568,774 | A | 10/1996 | Hutchison |
| 5,584,951 | A | 12/1996 | MacFarland |
| 5,592,885 | A | 1/1997 | Young et al. |
| 5,674,593 | A | 10/1997 | Earl |
| 5,797,832 | A | 8/1998 | Ong et al. |
| 5,809,907 | A | 9/1998 | Bumgarner |
| 6,095,061 | A | 8/2000 | Perazzo |
| 6,317,981 | B1 | 11/2001 | Clive-Smith |
| 6,612,247 | B1 | 9/2003 | Pistner et al. |
| 6,736,074 | B2 | 5/2004 | Pistner et al. |
| 6,758,148 | B2 | 7/2004 | Torrey et al. |
| 7,007,815 | B2 | 3/2006 | Anderson et al. |

OTHER PUBLICATIONS

International Search Report for corresponding International Application No. PCT/US2007/002403.

Written Opinion for corresponding International Application No. PCT/US2007/002403.

SHIPPING PALLET APPARATUS AND METHOD

CROSS REFERENCE TO RELATED APPLICATIONS

This application is a Continuation of U.S. application Ser. No. 12/373,679, filed on 14 Jan. 2010, which is a National Stage Application of PCT/US2007/02403, filed on 29 Jan. 2007, which claims the priority and benefits of U.S. Provisional Application 60/830,274 filed on 13 Jul. 2006, which is hereby incorporated by reference in its entirety.

BACKGROUND OF THE INVENTION

Field of the Invention

This invention relates to shipping pallets, and, more particularly, to shipping pallets fabricated, at least in part, from paper and paper based products.

Description of the Related Art

Traditional wood structural members have been used in a wide variety of applications. For example, shipping pallets have been constructed of wood structural members in the form of slats and/or runners or stringers of various dimensions. Such wooden shipping pallets are relatively costly even though made of relatively poor quality wood. The hasty assembly and poor wood quality result in shipping pallets that may rapidly become damaged to the point of being unusable. Moreover, such shipping pallets are relatively heavy, resulting in additional shipping costs to the shipper due to weight and volume of the pallets. Damaged and otherwise unusable shipping pallets may present a disposal problem.

As a result, shipping pallets fabricated from other materials have been developed, such as shipping pallets that include structural members fabricated from fiberboard sheets. Such shipping pallets may be at least partly recyclable. However, structural members fabricated from fiberboard sheets have been deficient in areas of strength, durability, and are prone to warping so that shipping pallets fabricated from such structural members may be deficient in performance.

Therefore, a need exists for shipping pallets that may be strong, durable, and, at least in part, recyclable.

SUMMARY OF THE INVENTION

Apparatus and methods in accordance with the present inventions may resolve many of the needs and shortcomings discussed above and will provide additional improvements and advantages that may be recognized by those skilled in the art upon review of the present disclosure.

Apparatus in accordance with various aspects of the present inventions may be configured as shipping pallets. The shipping pallets may include an upper deck and one or more runners. In certain configurations, the shipping pallets may also include a lower deck. The shipping pallets may be constructed from on or more structural members. A structural member having a core and a wrapper may be included in the upper deck or in at least one of the runners. The core may define at least a first core surface, a second core surface, a core lower surface and a core upper surface. The wrapper may be secured in tension over at least a portion of at least one of the first core surface, the second core surface, the core lower surface and the core upper surface of the core.

Methods in accordance with aspects of the present inventions may be utilized to form shipping pallets. The methods may include providing one or more fiberboard sheets and a wrapper. The core may be formed by laminating the one or more fiberboard sheets. The methods may include applying tension to the wrapper and forming one or more structural members by securing the wrapper to the core. The structural members may then be connected thereby forming at least a portion of the shipping pallet.

Other features and advantages of the invention will become apparent from the following detailed description, and from the claims.

Figure 1A:
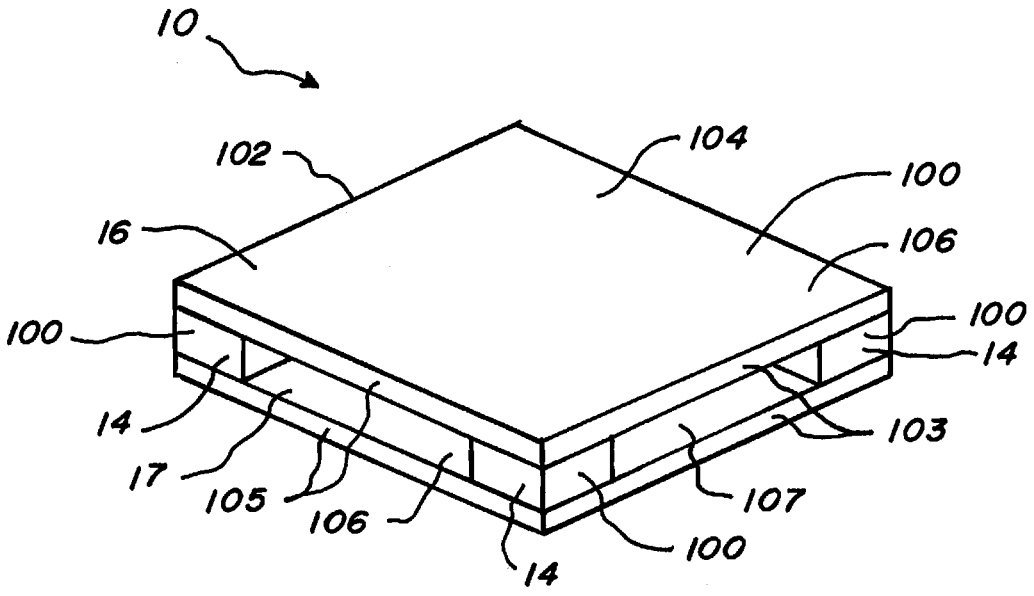
FIG. 1A illustrates a perspective view of an exemplary embodiment of a shipping pallet in accordance with aspects of the present inventions.

All Figures are illustrated for ease of explanation of the basic teachings of the present invention only; the extensions of the Figures with respect to number, position, relationship and dimensions of the parts to form the preferred embodiment will be explained or will be within the skill of the art after the following description has been read and understood. Further, the exact dimensions and dimensional proportions to conform to specific force, weight, strength, and similar requirements for various applications will likewise be within the skill of the art after the following description has been read and understood.

Where used in various Figures of the drawings, the same numerals designate the same or similar parts. Furthermore, when the terms "upper," "lower," "right," "left," "forward," "rear," "first," "second," "inside," "outside," and similar terms are used, the terms should be understood to reference only the structure shown in the drawings and utilized only to facilitate describing the illustrated embodiments.

DETAILED DESCRIPTION OF THE INVENTION

The Figures generally illustrate exemplary embodiments of a shipping pallet 10 that include aspects of the present inventions. The particularly illustrated embodiments of the shipping pallet 10 have been chosen for ease of explanation and understanding of various aspects of the present inventions. These illustrated embodiments are not meant to limit the scope of coverage but, instead, to assist in understanding the context of the language used in this specification and in the appended claims. Accordingly, the appended claims may encompass variations of shipping pallets 10 and their components that differ from the illustrated embodiments.

The present inventions provide shipping pallets 10 and associated methods for use in shipping and storage of various items. The shipping pallets 10 may be generally configured to support a load that may consist of various items. In some aspects, the shipping pallets 10 may be configured to be lifted by forklift and, in various aspects, may be configured to be placed, for example, in storage racks, cargo holds, storage bays, railroad cars, and truck trailers. The shipping pallets 10 may include an upper deck 16 and one or more runners 14 secured to the upper deck 16. The load may be placed on the upper deck 16. The runners 14 support the upper deck 16. The runners 14 may provide access, for example, for the tines of a forklift or for a pallet jack underneath the upper deck 16 so that the shipping pallet 10 may be lifted and moved about. In one aspect, a lower deck 17 may also be provided and the one or more runner 14 secured between the upper deck 16 and the lower deck 17. In one aspect, the shipping pallet 10 may be manufactured solely or predominantly from recyclable materials, such as, for example, paper and paper products.

The upper deck 16, the lower deck 17 and the one or more runners 14 may be formed from at least one structural member 100. In one aspect, two or more of the structural members 100 may be configured to compressionably interlock with one another to form portions of the shipping pallet 10. In another aspect, two or more of the structural members 100 may be secured together to form portions of the shipping pallet 10 by adhesives, by various fasteners, or by combinations of compression, adhesives, and fasteners.

The structural member 100 includes a core 20 and a wrapper 60 secured in tension to the core 20. The core 20 is typically formed from one or more fiberboard sheets 40 in lamination. The core 20 provides an internal support structure to the structural member 100. The wrapper 60 is also typically formed from a paper or other cellulose based material, so that the structural member 100 is largely paper-based. In forming the structural member 100, the wrapper 60 is placed in tension which may elastically stretch the wrapper 60. While the wrapper 60 is stretched under tension, the wrapper 60 is secured to portions of the surface of the core 20 so that the tension in the wrapper 60 squeezes the core 20. The tension in the wrapper 60 is transmitted to the core 20 as a compression force. Securing the wrapper 60 to the surface of the core 20 while the wrapper 60 is under tension may produce pre-tensioning or other desirable characteristics in the resulting structural member 100.

The wrapper 60 is typically formed from a material capable of being secured in tension over the core 20. In one aspect, the wrapper 60 is configured as a paper. The wrapper 60 may be configured to have the desired characteristics such as, for example, tensile strength, flexibility, resistance to tearing, and elasticity. In one aspect, the wrapper 60 may be secured over the core 20 in tension to provide desirable structural characteristics to the structural member 100.

The fiberboard sheet 40 or fiberboard sheets 40 that make up the core 20 may be such materials as, for example, fluted cardboard. As discussed below, specific embodiments of the fiberboard sheets 40 used in the core 20 may be chosen based upon particular design requirements including forces to be resisted by the core 20. Also, as discussed below, the orientation of the fiberboard sheets 40 in the core 20 as well as the geometric configuration of the fiberboard sheets 40 and the core 20 may also be chosen based upon specific design requirements.

The fiberboard sheet 40 may include at least one linerboard 44 and at least one medium 42. The one or more linerboards 44 are interposed with one or more mediums 42 to form the fiberboard sheet 40. The linerboard 44 is usually a flat sheet of paper. The paper may be a puncture resistant paper. In one aspect, the paper may be made from the pulp of softwoods or other materials with relatively longer fibers that result in a paper that may be strong in tension, resistant to puncturing and tearing, and tends to maintain its shape. The medium 42 may be a paper material configured in a series of flutes 70, which are arch shaped corrugations, to form a fluted medium 85. The flutes 70 define a series of flute tips 72. In one aspect, the medium 42 may be made from the pulp of hardwoods or other material with relatively short fibers that may result in a paper having good compression strength and that is easily moldable with moisture and heat.

The flute 70 may define a flute axis 76 and, accordingly, the series of flutes 70 in the fluted medium 85 form a series of parallel flute axes 76. Each flute 70 is typically configured as a column 82 about each flute axis 76, the flute axis 76 passing generally along the column length 84 of the column 82. The series of columns 82 into which the fluted medium 85 is configured may then define the load bearing axis 90 of the fiberboard sheet 40 such that the fiberboard sheet 40 may be more resistant to tensile or compressive forces exerted along the load bearing axis 90. For a fiberboard sheet 40 with a fluted medium 85, the load bearing axis 90 may be generally parallel to the flute axes 76.

Standard flute 70 designations such as A, B, C, E, and F are differentiated by a specific number of flutes 70 per unit length and the specific chordal heights 78. It will be appreciated that the fluted medium 85 strength along the load bearing axis 90 increases with flute density. The choice of flute density as well as the materials of medium 42 and linerboard 44, and choice of adhesive included in the fiberboard sheet 40 will depend upon the specific design requirements including the loads to be resisted.

As an alternative to a fluted medium 85, the medium 42 may be configured into a polygonal medium 86 which has a series of polygonal cells forming a honeycomb like structure. The polygonal medium 86 may define at least one load bearing axis 90 in the fiberboard sheet 40.

The fiberboard sheet 40 may be formed by securing one or more medium 42 to one or more linerboards 44 by various adhesives. In embodiments having a fluted medium 85, the flute tips 72 of the medium 42 are usually secured to linerboard 44. Adhesives that may used to secure the linerboard 44 to the medium 42 and may be otherwise used in the shipping pallet 10 according to the present invention include casein, polyvinylacetate or resorcinol glue or epoxy of polyester resin, starch-based adhesives, and other adhesives and bonding agents as would be readily recognized by those skilled in the art upon review of this disclosure. Starch-based adhesives may be recyclable, and, accordingly, may be advantageous in the present inventions.

The fiberboard sheet 40 may have any of a variety of configurations of mediums 42 and linerboards 44. For example, the fiberboard sheet 40 may be single face 46, single wall 47, double wall 48, or triple wall 49. In one aspect, the fiberboard sheet 40 may have a linerboard 44, fluted medium 85, linerboard 44, fluted medium 85 combination. The flute sizes may be different and the linerboards may be of dissimilar weight. The fiberboard sheet 40 may have other configurations of medium 42 and linerboard 44 that would be readily recognized by those skilled in the art upon review of this disclosure.

In other configurations, the fiberboard sheet 40 may have a medium 42 configured as solid medium 87 which is a non-fluted solid unit. In such embodiments, the fiberboard sheet 40 may consist only of a medium 42, or may have a laminated structure in which the laminations may have fibers with a directional orientation so that the fiberboard sheet 40 may have at least one load bearing axis 90.

The fiberboard sheet 40 may define a first surface 52 and a second surface 53. The fiberboard sheet 40 may also define an upper surface 56 and a lower surface 57, and a first end 54 and a second end 55. When the fiberboard sheet 40 is oriented for purposes of description with respect to an x, y, z coordinate system, the first surface 52 and the second surface 53 may be planar surfaces substantially normal to the x axis. The first surface 52 may include either medium 42 or linerboard 44, and the second surface 53 may also include either medium 42 or linerboard 44.

When so oriented, the upper surface 56 and the lower surface 57 of the fiberboard sheet 40 may include both medium 42 and linerboard 44 and may be oriented substantially normal to the z axis. The z axis may be substantially parallel to the load bearing axis 90 of the fiberboard sheet 40. More particularly, in embodiments of the fiberboard sheet 40 having a fluted medium 85, the z axis is generally parallel to the flute axes 76, and the upper surface 56 and the lower surface 57 include the open ends 73 of the flutes 70.

The first end 54 and the second end 55 of the fiberboard sheet 40 may be planar surfaces substantially normal to the y axis and may include both medium 42 and linerboard 44. In embodiments of the fiberboard sheet 40 having a medium 42 configured as a series of flutes 70, the first end 54 and the second end 55 may define planar surfaces generally parallel to the flute axes 76, A first length 62 and a second length 64 of the fiberboard sheet 40 may be defined where the first length 62 is the distance between the first end 54 and the second end 55 and the second length 64 is the distance between the upper surface 56 and the lower surface 57.

The core 20 may be a plurality of fiberboard sheets 40 in lamination. To form the core 20, the fiberboard sheets 40 may be disposed such that the first surfaces 52 and the second surfaces 53 lie in a spaced parallel orientation. The fiberboard sheets 40 may be oriented so that first ends 54 are similarly oriented, the second ends 55 are similarly oriented, the upper surfaces 56 are similarly oriented, and the lower surfaces 57 are similarly oriented. Each fiberboard sheet 40 is biased against the adjacent fiberboard sheet 40 or fiberboard sheets 40. For example, the second surface 53 of a first fiberboard sheet 40 is biased against the first surface 52 of second fiberboard sheet 40. The second surface 53 of the second fiberboard sheet 40 is biased against the first surface 52 of a third fiberboard sheet 40, and so forth. An adhesive may be applied so that the second surface 53 of the first fiberboard sheet 40 adheres to the first surface 52 of the second fiberboard sheet 40, and so on, to laminate the fiberboard sheets 40 into the core 20.

The first surface 52 of the first fiberboard sheet 40 and the second surface 53 of the final fiberboard sheet 40 define a first core surface 22 and a second core surface 23, respectively, and, for purposes of description, may be oriented substantially normal to the x axis. The core upper surface 26 and the core lower surface 27 may be oriented substantially normal to the z axis for purposes of description. The core upper surface 26 and the core lower surface 27 may be defined by the upper surfaces 56 and lower surfaces 57 respectively of the laminated fiberboard sheets 40. The core first end 24 and the core second end 25 may be oriented substantially normal to the y axis. The core first end 24 and the core second end 25 may be defined by the first ends 54 and the second ends 55 respectively of the laminated fiberboard sheets 40.

It should be appreciated that the core 20 may be constructed of fiberboard sheets 40 having the same configuration of mediums 42 and linerboards 44 or may be constructed of combinations of fiberboard sheets 40 having various combinations of mediums 42 and linerboard 44. For example, the core 20 may be constructed entirely of single wall 47 fiberboard sheets 40 having a fluted medium 85 with a size C flute. As another example, the core 20 may be constructed as a combination of single wall 47 fluted medium 85 with an A flute and double wall 48 with a fluted medium 85 with an F flute. It should also be appreciated that the fiberboard sheets 40 in the core 20 do not necessarily have the same orientation. The fiberboard sheets 40 may be variously oriented as well in order to obtain various mechanical properties. For example, the core 20 may be laminated from several fiberboard sheets 40 having a fluted medium 85. Some of the fiberboard sheets 40 may be oriented so that the flute axes 76 generally align with the z axis, while other fiberboard sheets 40 may be interposed that are oriented with the flute axes 76 generally aligned with the y axis.

In some embodiments, each of the fiberboard sheets 40 may have substantially similar size and geometric shape. The fiberboard sheets 40 may be aligned so that the first end 54 of the first fiberboard sheet 40 is matched with the first end 54 of the second fiberboard sheet 40, and so on in succession. The second ends 55 may be similarly aligned. Accordingly, the succession of first ends 54 in the lamination defines a core first end 24 configured as a flat surface, and the succession of second ends 55 defines a core second end 25 configured as a flat surface.

In other embodiments, the fiberboard sheets 40 that are laminated to make up the core 20 may have differing first lengths 62. Accordingly, the succession of first ends 54 in lamination may define a core first end 24 configured as a curved surface or other surface configuration, and the succession of second ends 55 in lamination may define a core second end 25 configured as a curved surface or other surface configuration.

The upper surface 56 of the first fiberboard sheet 40 may be in parallel alignment with the upper surface 56 of the second fiberboard sheet 40, and so on in succession, such that the upper surfaces 56 of the plurality of fiberboard sheets 40 define a core upper surface 26 configured as a flat surface. In some embodiments, the lower surfaces 57 of the plurality of fiberboard sheets 40 may be similarly aligned to define a core lower surface 27 configured as a flat surface.

In other embodiments, the second lengths 64 of the fiberboard sheets 40 that are laminated together to form the core 20 may vary with respect to the first length 62 so that the lower surface 57 is curved or otherwise non-planar. For example, the upper surface 56 of the first fiberboard sheet 40 may be in parallel alignment with the upper surface 56 of the second fiberboard sheet 40, and so on in succession, such that the upper surfaces 56 of the plurality of fiberboard sheets 40 define a core upper surface 26 configured as a flat surface, while the succession of lower surfaces 57 define a core lower surface 27 configured as an arch or other varied shape that may, inter alia, be structurally advantageous in certain applications. Other embodiments may also be readily apparent to those skilled in the art upon review of this disclosure. Again, the choice of first length 62, second length 64, and other properties of the fiberboard sheets 40 as well as the arrangement of the fiberboard sheets 40 that are laminated to form the core 20 is a matter of design choice that may depend upon the specific design requirements including the forces to be resisted by the resulting structural member 100. The configurations of the core first end 24, core second end 25, core upper surface 26, and core lower surface 27 that result from laminating fiberboard sheets 40 are also a matter of design choice that may depend upon the specific design requirements.

The core 20 may also be formed from a single fiberboard sheet 40 laminated by winding or wrapping the fiberboard sheet 40 around itself. Alternatively, fiberboard sheets 40 in succession may be butted second end 55 to first end 54. The second end 55 may be secured to the first end 54 by adhesive. The fiberboard sheets 40 in succession may then be laminated by being wound or wrapped around to form the core 20. Adhesive may be used to secure the continuously wound laminations to each other.

A wrapper 60 is then secured to at least portions of the core 20 to enclose at least portions of the core 20 to form the structural member 100. The wrapper 60 may be made of linerboard 44, kraft paper, or other sheet materials as would be recognized by those skilled in the art upon review of the present disclosure. Use of softwood paper in the wrapper 60 may be advantageous because softwood paper tends to be strong in tension. The wrapper 60 may have the load bearing axis 90 that may, for example, correspond to the directional orientation of the fibers in the wrapper 60 such that the wrapper 60 is more resistive to tensions in the direction of the load bearing axis 90. A plurality of wrappers 60 may be used to enclose portions of the core to form the structural member 100. In embodiments of the structural member 100 having more than one wrapper 60, the wrappers 60 may be made of different materials or otherwise differently configured.

A tension $T_f$ may be applied to the wrapper 60. The wrapper 60 may be placed in tension with tension $T_f$ by a brake or other mechanisms that would be recognized by those skilled in the art upon review of the present disclosure, and then secured to the core 20 while in tension. If the wrapper 60 has the load bearing axis 90 with respect to tensions $T_f$, the wrapper 60 may be tensioned along the load bearing axis 90. The tension $T_f$ may be greater than the tension that may normally be present from, for example, drawing the wrapper off of a roll. The tension $T_f$ may be particularly engineered to produce corresponding compressions in the core 20 when the wrapper 60 is secured to the core 20.

The wrapper is then secured to the core while subject to tension $T_f$. The wrapper 60 may be secured in tension to the core 20 with one or more adhesives, the wrapper 60 may be secured in tension to itself about the core 20 by adhesive, or both. The wrapper 60 may then be held in tension with tension $T_f$ until the adhesive sets or cures sufficiently to secure the wrapper 60 in tension to the core 20. When secured to the core 20, the tension in the wrapper 60 may place the core 20 in a corresponding compression thereby creating a pre-stressed structural member 100. The core 20 in combination with the wrapper 60 forms a structural member 100 that may carry and transfer stresses and moments.

The structural member 100 includes the core 20 and the wrapper 60. The structural member 100 may define a first structural member surface 102, a second structural member surface 103, a structural member first end 104, a structural member second end 105, a structural member upper surface 106, and a structural member lower surface 107. For purposes of description, in the case of a rectangular structural member 100, the x axis may then be normal to the first structural member surface 102 and the second structural member surface 103, and the y axis may be normal to the first structural member end and the second structural member end. The first structural member surface 102, the second structural member surface 103, the structural member first end 104, the structural member second end 105, the structural member upper surface 106, and the structural member lower surface 107 may generally correspond to the first core surface 22, the second core surface 23, the core first end 24, the core second, the core upper surface 26, and the core lower surface 27, respectively.

The wrapper 60 may be in tension $T_f$ oriented with respect to the x axis, the y axis, the z axis, or combinations thereof. Application of the tension $T_f$ to the wrapper 60 may cause the wrapper 60 to stretch. The wrapper 60 stretched by tension $T_f$ may be secured to various surfaces or combinations of surfaces of the core 20. After the wrapper 60 is secured to the core 20, the stretched wrapper 60 may squeeze at least a portion of the core 20 thereby producing a compression force in at least a portion of the core 20. This may pre-stress at least a portion of the core 20.

Multiple wrappers 60 having differing tensions $T_f$ may be secured to the core 20. The orientations of the tensions $T_f$ in the wrapper 60 or wrappers 60 as well as the surfaces of the core 20 to which the wrapper 60 or wrappers 60 are secured with tensions $T_f$ may be chosen to provide pre-stressing in the resulting structural member 100 in accordance with various structural and other design requirements.

Recycled materials as well as recyclable materials may be used, at least in part in the core 20 and in the wrapper 60. After use, the structural member 100 according to the present invention may be, at least in part, recyclable. The structural member 100 may have additional useful properties. For example, the structural member 100 may have insulating properties, may have sound absorptive properties, may be light weight in comparison to other materials, and may also provide cushioning, vibration damping, and other shock absorptive properties.

The structural member 100 may be further engineered to have additional properties. For example, the materials used in the core 20 or in the wrapper 60 or both may be treated at least in part with, inter alia, fire retardants, insecticides, pesticides, fungicides, and waterproofing to inhibit deterioration. Materials having such properties may be incorporated into the core 20, the wrapper 60, or both. Other materials such as metal foils, plastics, resin impregnated paper, and other fibrous materials such as fibrous glass materials could be incorporated into aspects of the shipping pallet 10 according to the present inventions including the structural member 100.

In operation, the shipping pallet 10 may be used to transport and store materials in the same manner as a standard wooden pallet. The shipping pallets 10 may be constructed, at least in part, from structural members 100. When the shipping pallet's 10 useful life is completed, the shipping pallet 10 may be disposed of, at least in part, by recycling. Other devices that would be recognized by those skilled in the art upon review of the present disclosure may be fabricated, at least in part, from structural members 100 according to the present inventions.

Figure 1B:
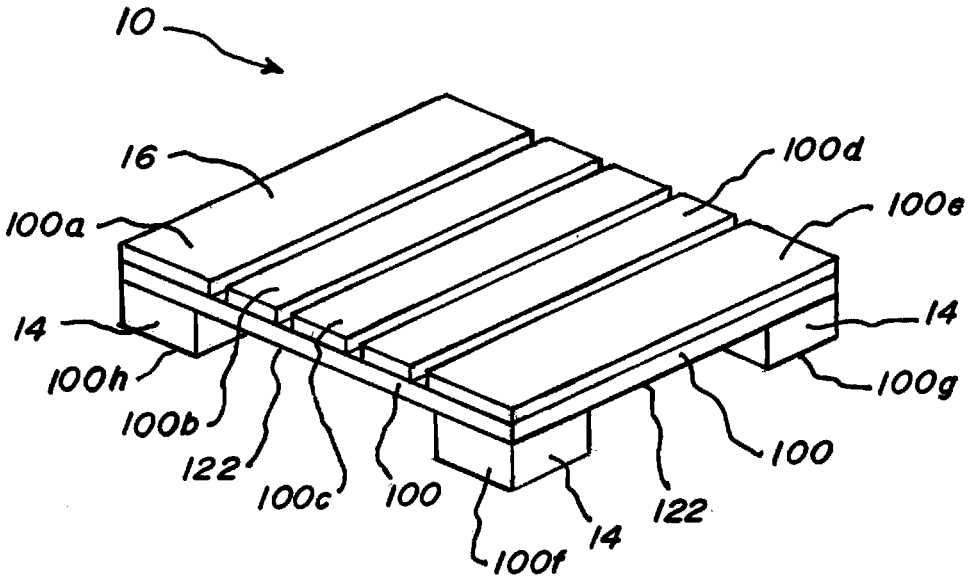
FIG. 1B illustrates a perspective view of another exemplary embodiment of a shipping pallet in accordance with aspects of the present inventions.

Turning now to the Figures, aspects of the present inventions including a shipping pallet 10 formed at least in part from structural members 100 are illustrated in FIGS. 1A and 1B. The embodiment of the shipping pallet 10 illustrated in FIG. 1A has an upper deck 16 and a lower deck 17 separated by runners 14. The upper deck 16 is constructed of a single structural member 100. The lower deck 17 is also constructed of a single structural member 100. Runners 14, which are formed from structural members 100 according to the present inventions, are interposed between the upper deck 16 and the lower deck 17 and secure the upper deck 16 to the lower deck 17. The runners 14 may be sized so that, for example, the tines of a forklift could pass between the upper deck 16 and the lower deck 17 of the shipping pallet 10. A load may be placed on the upper deck 16, transported on the shipping pallet 10, and stored on the shipping pallet 10. The shipping pallet 10, in this embodiment, is made from structural members 100 that may be largely made from materials that may be recyclable so that the shipping pallet 10 may be disposed of by recycling.

In FIG. 1B, an embodiment of a shipping pallet 10 formed from structural members 100 is illustrated. The shipping pallet 10 in this embodiment has an upper deck 16 secured to runners 14. The upper deck 16 is formed from several structural members 100 that are attached to stringers 122. The stingers 122 are, in turn, secured to runners 14. The stringers 122 and the runners 14, in this embodiment, are formed from structural members 100. The structural members 100 in the embodiments of FIGS. 1A and 1B may be secured to one another to form the shipping pallet 10 by adhesive, compressionably, or by various fasteners, or by combinations thereof as would be recognized by those skilled in the art upon review of the present disclosure. Also, based upon this disclosure, those skilled in the art would recognize various other configurations for the shipping pallet 10 and would also recognize that wood, steel, and other materials could be substituted for one or more of the structural members 100 in the illustrated embodiments. For example, the runners 14 could be made of wood and the upper deck 16 made of structural members 100.

Figure 2A:
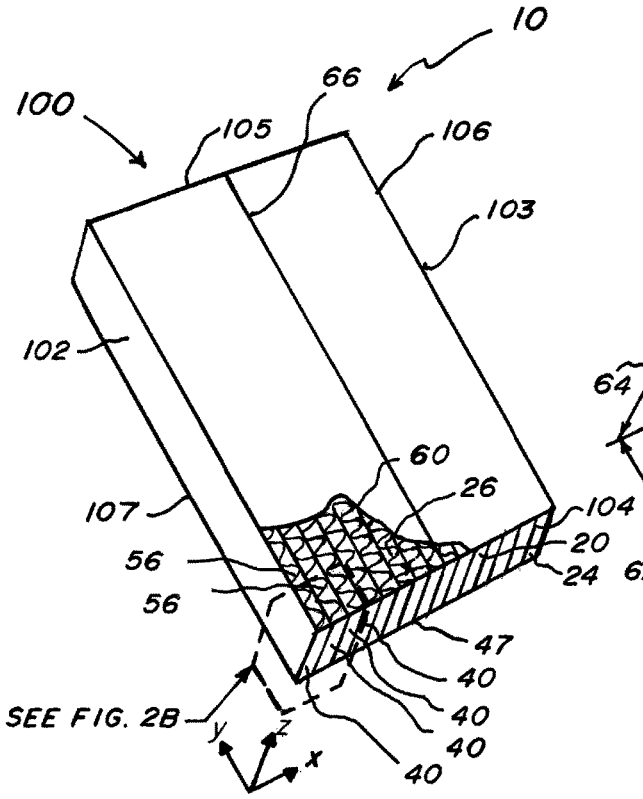
FIG. 2A illustrates a perspective view of an exemplary embodiment of a structural member in accordance with aspects of the present inventions.

A structural member 100 is generally illustrated in FIG. 2A. For purposes of description, the structural member 100 is generally aligned with the x, y, z coordinate system as illustrated. The structural member 100, as illustrated, has a generally rectangular shape and rectangular cross-section and defines a first structural member surface 102, second structural member surface 103, structural member first end 104, structural member second end 105, structural member upper surface 106, and structural member lower surface 107. The structural member 100 includes a core 20 wrapped with a wrapper 60. In this embodiment of the structural member 100, the core first end 24 and the core second end 25 are not covered by the wrapper 60, although in other embodiments the core first end 24 and the core second end 25 could be covered by the wrapper 60. A seam 66 in the wrapper 60 is illustrated where the wrapper 60 is adjoined to itself. In this illustration, a portion of the wrapper 60 is "peeled back" to expose a portion of the core 20 including the orientation of the flutes 70 within the fiberboard sheets 40 with fluted medium 85 from which the core 20 in this embodiment is fabricated.

The core 20, as illustrated in FIG. 2A, is fabricated from a number of single wall 47 fiberboard sheets 40 with fluted medium 85 disposed such that the linerboards 44 lie in a spaced parallel orientation and the mediums 42 lie in a spaced parallel orientation. Each fiberboard sheet 40 in the core 20 is biased against the adjacent fiberboard sheet 40 or sheets in the lamination, as shown. The upper surfaces 56 of the fiberboard sheets 40 are aligned to define a substantially planar core upper surface 26 as illustrated. In combination with the wrapper 60, the upper surfaces of the fiberboard sheets 40 define the structural member upper surface 106, which is also substantially planar in this embodiment.

Figure 2B:
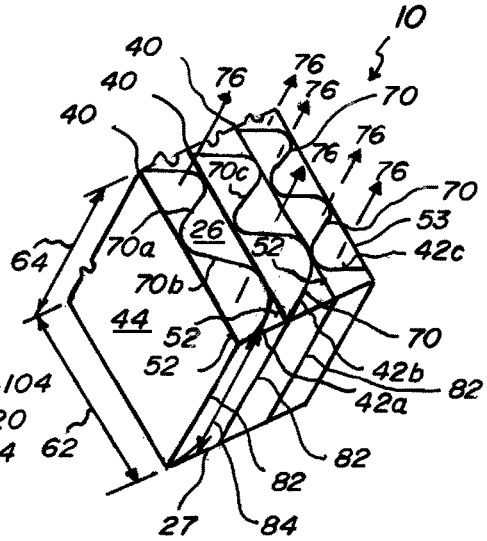
FIG. 2B illustrates a perspective view of an exemplary embodiment of a core in accordance with aspects of the present inventions.

A detail of the construction of the core 20 is illustrated in FIG. 2B. As illustrated, the core 20 is formed from a series of single wall 47 fiberboard sheets 40 with a fluted medium 85. One skilled in the art upon review of this disclosure would understand that other configurations of fiberboard sheets 40, such as, for example, single face 46, double wall 48, and triple wall 49, and having various configurations of mediums 42, either alone or in combination, could be used to construct the core 20. As illustrated, the second surface 53 of the first fiberboard sheet 40 is secured to the first surface 52 of the second fiberboard sheet 40, and so forth, thereby forming the core 20. The fluted medium 85 is oriented so that the open ends 73 of the fluted medium 85 form the core upper surface 26 and the core lower surface 27 and underlie the structural member upper surface 106 and the structural member lower surface 107.

As illustrated in FIG. 2B, the medium 42 in each fiberboard sheet 40 is configured as a fluted medium 85 with each flute 70 in the fluted medium 85 defining a flute axis 76, and, accordingly, the series of flutes 70 in the medium 42 define a series of parallel flute axes 76. Each flute 70 is configured as a column 82 about the flute axis 76, the flute axis 76 passing generally along the length of the column 82. The fiberboard sheets 40 are positioned in this embodiment so that the flutes 70 in the respective sheets form a more or less regular pattern. In the Figure, the flute axes 76 form a generally linear and parallel progression such that the columns 82 form a generally linear and parallel progression. The columns 82 formed by the flutes 70 pass from the core upper surface 26 to the core lower surface 27 so that a load applied to the structural member upper surface 106, and, hence, to the core upper surface 26 may be supported, at least in part, by these columns 82. Accordingly, in this embodiment, the structural member upper surface 106 and the structural member lower surface 107 are more or less normal to the load bearing axis 90 of the fiberboard sheets 40 that form the core 20 so that, for example, normal forces applied to the structural member upper surface 106 would act along this load bearing axis 90.

Figure 2C:
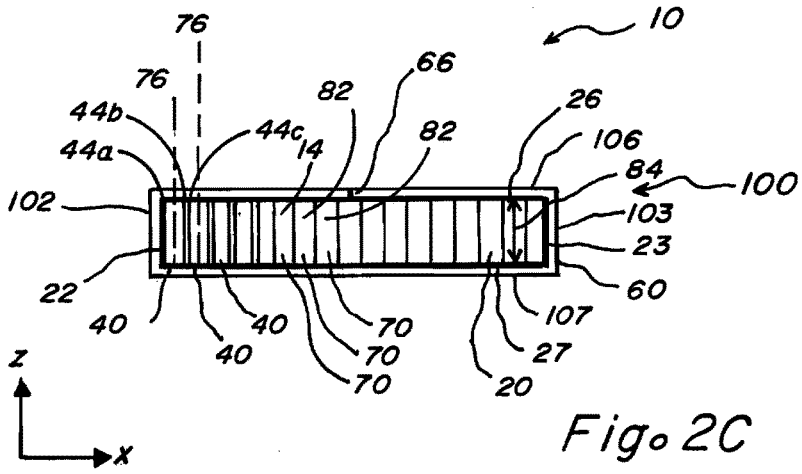
FIG. 2C illustrates an end view of an exemplary embodiment of a structural member in accordance with aspects of the present inventions.

A cross-section of the structural member 100 is illustrated in FIG. 2C including the wrapper 60 and the core 20. The wrapper 60 is secured to the core 20 to form the structural member 100 as illustrated. The core 20, in turn, is a lamination of a series of fiberboard sheets 40 with each fiberboard sheet including at least one linerboard 44 secured to a medium 42. The medium 42 forms a series of flutes 70. In this embodiment, the flutes 70 in the lamination of fiberboard sheets 40 form a substantially regular succession of columns 82 across the core 20 from the first core surface 22 to the second core surface 23 that may support a load.

Figure 3D:
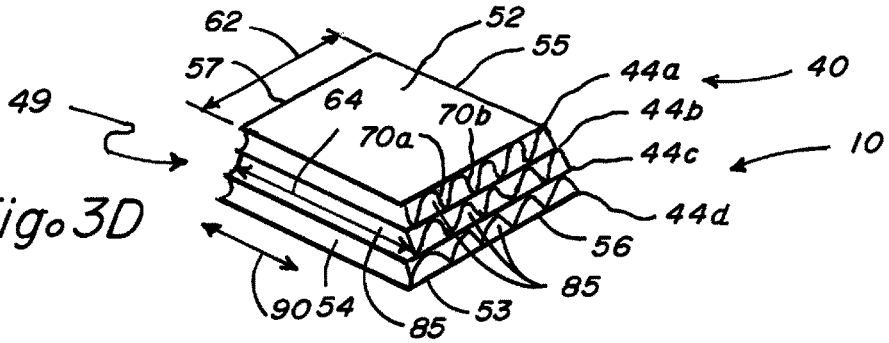
FIG. 3D illustrates a perspective view of an exemplary embodiment of a triple wall fiberboard sheet in accordance with aspects of the present inventions.
Figure 3C:
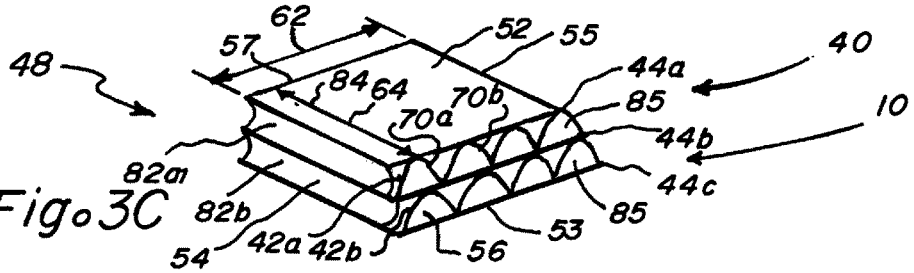
FIG. 3C illustrates a perspective view of an exemplary embodiment of a double wall fiberboard sheet in accordance with aspects of the present inventions.
Figure 3B:
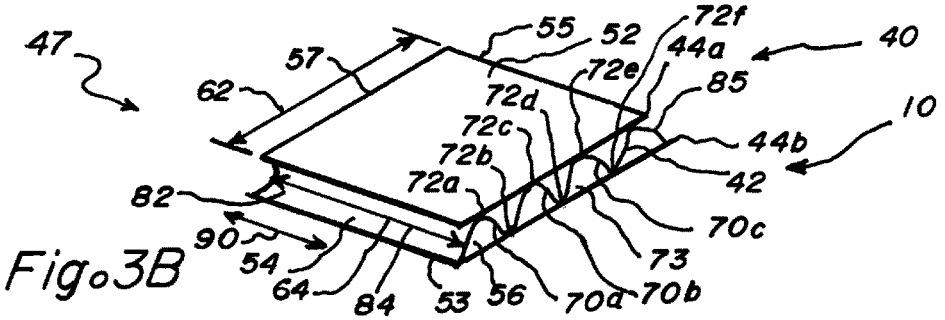
FIG. 3B illustrates a perspective view of an exemplary embodiment of a single wall fiberboard sheet in accordance with aspects of the present inventions.
Figure 3A:
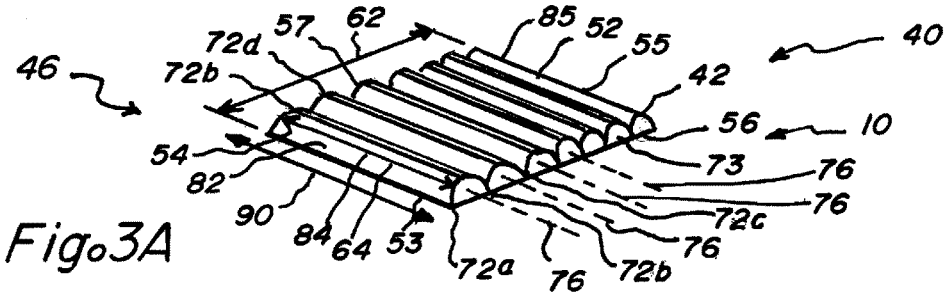
FIG. 3A illustrates a perspective view of an exemplary embodiment of a single face fiberboard sheet in accordance with aspects of the present inventions.

A single face 46 fiberboard sheet 40 is illustrated in FIG. 3A. In this embodiment of a single face 46 fiberboard sheet 40, a linerboard 44 is secured to the flute tips 72*a*, 72*c*, 72*e* of the medium 42 configured as a fluted medium 85. A single wall 47 fiberboard sheet 40 is illustrated in FIG. 3B. The single wall 47 fiberboard sheet 40 is formed by securing a fluted medium 85 between a first linerboard 44*a* and a second linerboard 44*b*. The flute tips 72*a*, 72*c* of the flutes 70 are secured to the first linerboard 44*a* and the flute tips 72*b*, 72*d* of the flutes 70 are secured to the second linerboard 44*b* in an alternating pattern, as illustrated. A double wall 48 fiberboard sheet 40 has a first medium 42*a* secured between the first linerboard 44*a* and the second linerboard 44*b*, and a second medium 42*b* secured between the second linerboard 44*b* and a third linerboard 44*c*, as illustrated in FIG. 3C. A triple wall 49 fiberboard sheet 40 has the first medium 42*a* secured between the first linerboard 44*a* and the second linerboard 44*b*, the second medium 42*b* secured between the second linerboard 44*b* and the third linerboard 44*c*, and a third medium 42*c* secured between the third linerboard 44*c* and a fourth linerboard 44*d*, as illustrated in FIG. 3D. The above cited fiberboard sheet 40 structures may be combined in various ways to form fiberboard sheets 40 having various structures of medium 42 and linerboard 44. For example, a fiberboard sheet 40 could be a combination of two single face 46 so that the fiberboard sheet 40 has a linerboard 44, medium 42, linerboard 44, medium 42 structure. The mediums may be either similar or dissimilar and the linerboards may also be either similar or dissimilar in such a fiberboard sheet. Other configurations for the fiberboard sheet may also be used in the present inventions as would be recognized by those skilled in the art upon review of this disclosure.

Figure 3E:
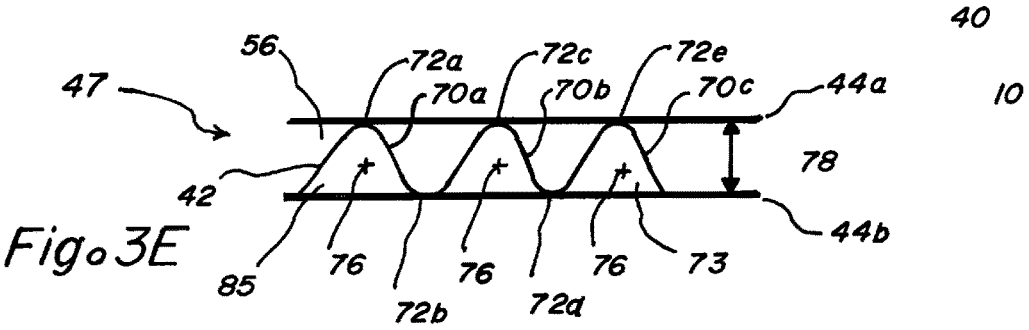
FIG. 3E illustrates an end view of an exemplary embodiment of a single face fiberboard sheet in accordance with aspects of the present inventions.

FIG. 3E illustrates a view of an embodiment of a single wall 47 fiberboard sheet 40 with a fluted medium 85 as viewed from the open end 73 of the flutes 70*a*, 70*b*, 70*c*. As illustrated, the flutes 70*a*, 70*b*, 70*c* form a succession of arch shaped structures between the linerboards 44*a*, 44*b*. The medium 42 is secured to the linerboards 44 generally at the flute tips 72*a*, 72*b*, 72*c* with alternating flute tips 72*a*, 72*b*, 72*c* secured to linerboard 44*a* and to linerboard 44*b* in succession. The gap between linerboard 44*a* and linerboard 44*b* generally corresponds to the chordal height 78 of the flutes 70.

Figure 4C:
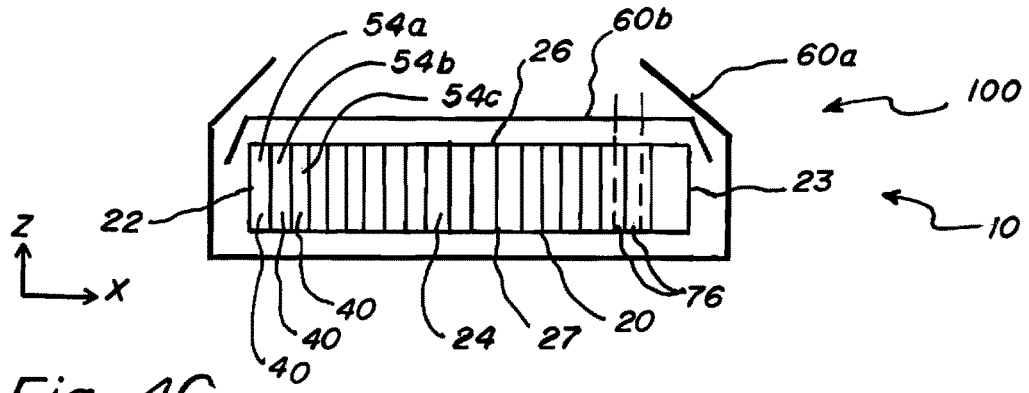
FIG. 4C illustrates an exploded top view of an exemplary embodiment of a shipping pallet in accordance with aspects of the present inventions.
Figure 4B:
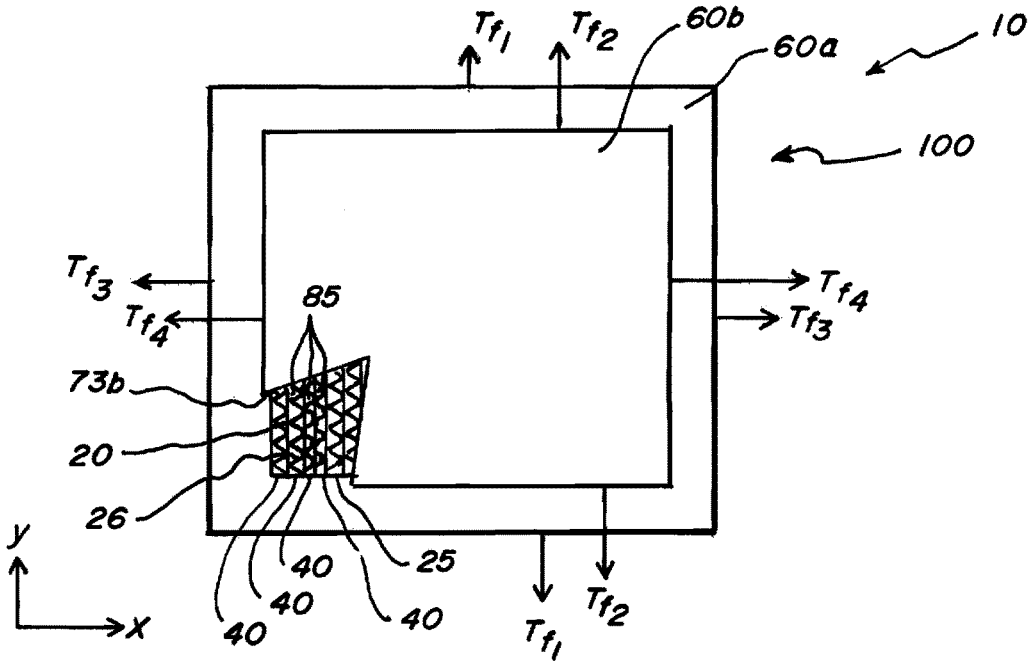
FIG. 4B illustrates an exploded front view of an exemplary embodiment of a shipping pallet in accordance with aspects of the present inventions.
Figure 4A:
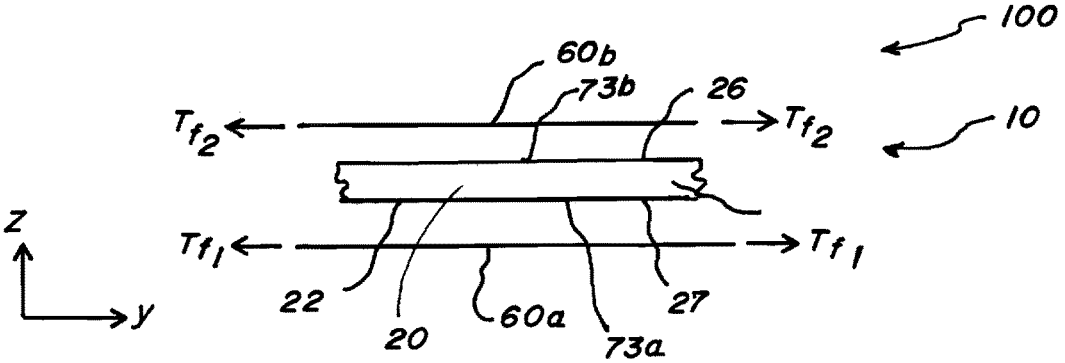
FIG. 4A illustrates an exploded side view of an exemplary embodiment of a shipping pallet in accordance with aspects of the present inventions.

FIGS. 4A, 4B, and 4C generally illustrate embodiments of a structural member 100 according to the present inventions including the formation of the structural member 100. FIG. 4A illustrates an exploded view of the formation of the structural member 100 as a first wrapper 60*a* and a second wrapper 60*b* are applied to the core 20. In this embodiment, the core 20 is a lamination of a plurality of fiberboard sheets 40 with fluted mediums 85. The flute axes 76 are generally oriented parallel to the z axis for purposes of description in this illustration. The second wrapper 60*b* in second tension $T_{f2}$ in a direction generally along the y axis as illustrated is adhesively applied to the core upper surface 26. The first wrapper 60*a* in first tension $T_{f1}$ in the direction generally along the y axis as illustrated is adhesively applied to the core lower surface 27. In this embodiment, the first tension $T_{f1}$ is substantially less than the second tension $T_{f2}$, and the first tension $T_{f1}$ may, in fact, be negligible or substantially zero. In other embodiments, the first tension $T_{f1}$ and the second tension $T_{f2}$ may be substantially equal. In still other embodiments the first tension $T_{f1}$ could be substantially greater than the second tension $T_{f2}$, and the second tension $T_{f2}$ could be negligible or substantially zero. When the wrappers 60*a*, 60*b* are secured to the core 20 in tension, the first tension $T_{f1}$ in first wrapper 60*a* and the second tension $T_{f2}$ in second wrapper 60*b* may place the underlying core 20 in compression and thus pre-stress the structural member 100. Differences between the first tension $T_{f1}$ in first wrapper 60*a* and second tension $T_{f2}$ in second wrapper 60*b* may differentially pre-stress the resulting structural member 100 so that the resulting structural member 100 may more effectively carry a load in certain orientations.

The wrappers 60*a*, 60*b* may be applied to the core 20 in a continuous flow process, as illustrated, and the core 20 with the wrapper 60*a*, 60*b* secured thereto then cut into predetermined lengths. The first tension $T_{f1}$ and second tension $T_{f2}$ may be created in wrappers 60*a*, 60*b*, for example, by a braking action on the paper web during the application process.

In some embodiments, first wrapper 60*a* and second wrapper 60*b* could have tensions $T_f$ generally oriented along the x axis and along the z axis, or combinations thereof, as well as along the y axis per FIG. 4A prior to being secured to the core 20 in order to create various pre-stressings in the resulting structural member 100.

FIG. 4B shows a top view of the wrappers 60*a*, 60*b* being applied to the core 20. In this view, a portion of second wrapper 60*b* is omitted to expose a portion of the core 20 including the open ends 73 of the flutes 70. This Figure illustrates the orientation of the first tension $T_{f1}$ in first wrapper 60*a* and second tension $T_{f2}$ in second wrapper 60*b* with respect to the laminated fiberboard sheets 40 that form the core 20. In this embodiment, the first tensions $T_{f1}$ in first wrapper 60*a* and second tension $T_{f2}$ in second wrapper 60*b* are oriented generally parallel to the first lengths 62 of the fiberboard sheets 40 that make up the core 20. Third tension $T_{f3}$ and fourth tension $T_{f4}$, which are normal to tensions $T_{f1}$ and $T_{f2}$, respectively, may also be applied to the wrappers 60*a*, 60*b*, as illustrated in FIG. 4B. The third tension $T_{f3}$ and fourth tension $T_{f4}$ are oriented generally in the x coordinate direction in the illustration. When wrappers 60*a*, 60*b* are secured to the core 20, third tensions $T_{f3}$ in wrappers 60*a* and fourth tension $T_{f4}$ in wrapper 60*b* may compress the core 20 in the x coordinate direction to prevent buckling failure of the columns 82 in the fluted medium 85. Also when wrappers 60*a*, 60*b* are secured to the core 20, the third tensions $T_{f3}$ may have an orientation generally in the z coordinate direction in portions of wrapper 60*a* and the fourth tension $T_{f4}$ may also have components generally in the z coordinate direction in portions of wrapper 60*b*. Accordingly, the third tension $T_{f3}$ and fourth tension $T_{f4}$ in wrappers 60*a*, 60*b* respectively may compress the core 20 in the z coordinate direction when wrappers 60*a*, 60*b* are secured to the core 20. This may provide pre-stressing with component in the z coordinate direction in the structural member 100.

In various embodiments, first wrapper 60*a* and second wrapper 60*b* may be in various tensions $T_f$ and combinations of tensions $T_f$, and additional wrappers 60*c*, 60*d* having tensions $T_f$ in various directions could be used in order to engineer stresses into the structural member 100, as would be recognized by those skilled in the art upon review of this disclosure. When secured to the core 20, the tensions $T_f$ in the wrappers 60 or wrappers 60*a*, 60*b* may have components in the x, y, and z directions and may produce corresponding compression forces in the core having x, y and z components thereby pre-stressing the structural member 100 in the x, y, and z directions. Other advantages may also be gained by variously tensioning the wrapper 60 or wrappers 60*a*, 60*b* and affixing the wrapper 60 or wrappers 60*a*, 60*b* in tension to the core 20 so that the tension $T_f$ is imparted as a corresponding compression force to the core 20.

FIG. 4C illustrates a front exploded view of the core 20 being wrapped with first wrapper 60*a* and second wrapper 60*b*. In this embodiment, second wrapper 60*b* is secured to the core upper surface 26, and portions of second wrapper 60*b* are folded and secured to the first core surface 22 and to the second core surface 23. First wrapper 60*a* folds over second wrapper 60*b* and is adhesively secured both to the core 20 and to second wrapper 60*b* as illustrated. A portion of the core 20 would then be covered with two layers of wrapper 60, and two seams 66 may be formed in the resulting structural member 100 in this particular embodiment. In other embodiments, the core 20 could be wrapped by the wrapper 60 in various ways and could have multiple layers of wrapper 60 and/or multiple wrappers 60*a*, 60*b*, 60*c* as would be recognized by those skilled in the art upon review of this disclosure.

Figure 5A:
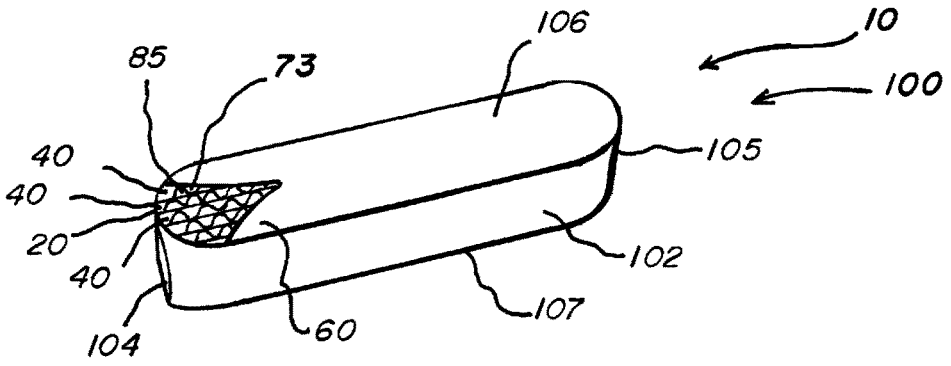
FIG. 5A illustrates a perspective view of an exemplary embodiment of a structural member in accordance with aspects of the present inventions.
Figure 5B:
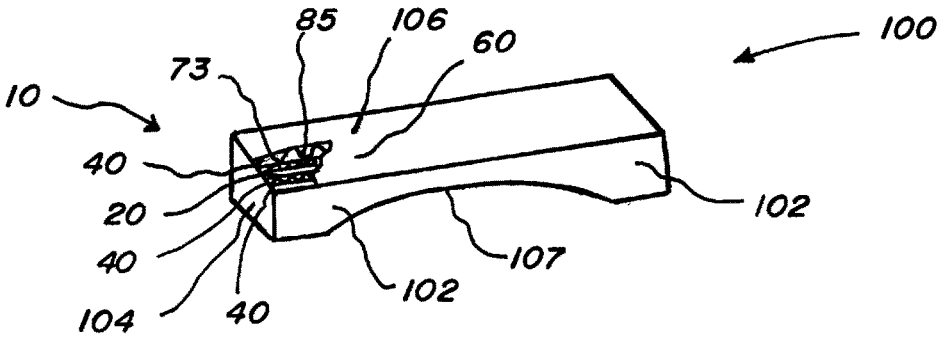
FIG. 5B illustrates a perspective view of another exemplary embodiment of a structural member in accordance with aspects of the present inventions.

Additional shapes of structural members 100 as used in the shipping pallet 10 according to the present inventions are illustrated in FIGS. 5A and 5B. In FIG. 5A, a portion of the wrapper 60 is omitted so that a portion of the underlying core 20 of the structural member 100 is visible. The open ends 73 of the fluted medium 85 of the fiberboard sheets 40 that form the core 20 are oriented toward the structural member upper surface 106 and structural member lower surface 107. In this embodiment, the fiberboard sheets 40 that form the core 20 have differing first lengths 62. The succession of first ends 54 define a core first end 24 configured as a curved surface or other surface configuration, and the succession of second ends 55 define a core second end 25 configured as a curved surface or other surface configuration, which, in conjunction with the wrapper 60 form a structural member 100 with a curves structural member first end 104 and a curved structural member second end 105. This embodiment of the structural member 100 could be used, for example, as the runner 14 in a shipping pallet 10.

FIG. 5B illustrates another embodiment of the structural member 100. In FIG. 5B, a portion of the wrapper 60 is omitted so that a portion of the underlying core 20 of the structural member 100 is visible. The open ends 73 of the fluted medium 85 of the fiberboard sheets 40 that form the core 20 are oriented toward the structural member upper surface 106 and structural member lower surface 107. In this embodiment, the core 20 of the structural member is laminated from a plurality of fiberboard sheets 40 wherein the second length 64 of the fiberboard sheets 40 varies along the first length 62 of the fiberboard sheets 40 to form a curved lower surface 57 in the fiberboard sheets 40. The core 20 that results from laminating these fiberboard sheets 40 has an arched core lower surface 27. Various tensions $T_f$ may be applied to the wrapper 60 and the wrapper 60 secured in tension to the core 20 in order to pre-stress the resulting structural member 100. The result is an arch shaped pre-stressed structural member 100 as illustrated.

Figure 5C:
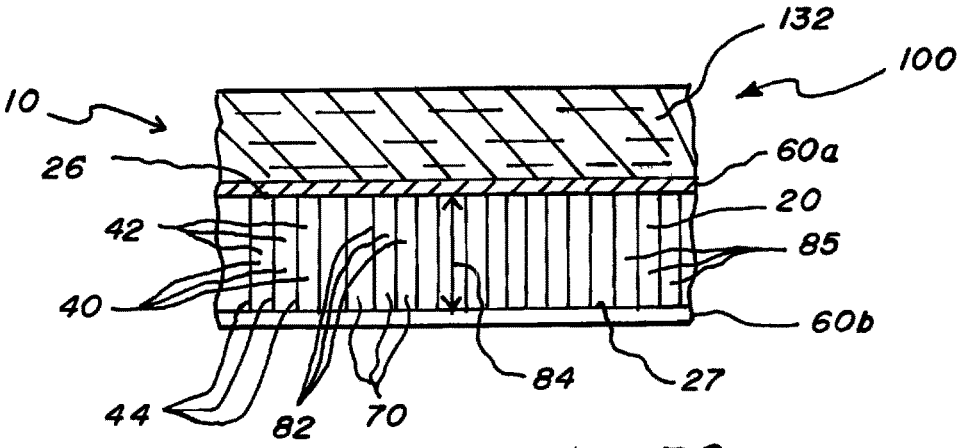
FIG. 5C illustrates a cross-sectional view of portions of another exemplary embodiment of aspects of a structural member in accordance with aspects of the present inventions.

Additional elements may be added to the structural member 100 in order to enhance the performance of the structural member 100. For example, FIG. 5C illustrates in a cross-sectional view portions of an embodiment of a structural member 100 that includes a wood sheet 132. In this embodiment, the core 20 is laminated from a series of fiberboard sheets 40 with a fluted medium 85. Wrapper 60*a* and wrapper 60*b* are secured in tension to the core 20 at the core upper surface 26 and the core lower surface 27, respectively. A wood sheet 132, which could be a wooden board or a series of wooden boards, plywood, veneer, chipboard, or similar, is then secured to wrapper 60*a*. The addition of the wood sheet 132 in this embodiment of the structural member 100 may add strength to the structural member 100. This embodiment of the structural member 100 may be particularly useful for runners 14. A pallet 10 configured with such runners 14 could be used for racking.

Figure 6:
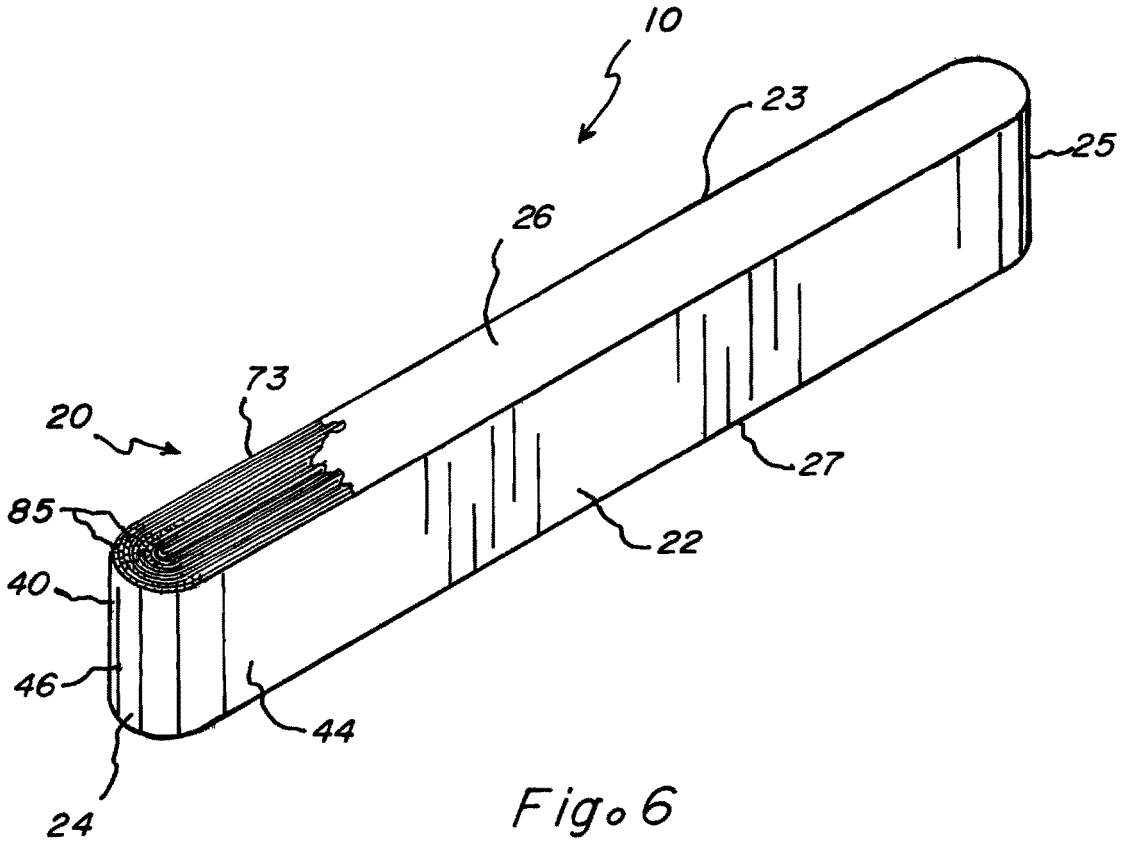
FIG. 6 illustrates a perspective view of an exemplary embodiment of a core in accordance with aspects of the present inventions.

FIG. 6 illustrates an embodiment of the core 20 formed from a single fiberboard sheet 40 laminated by winding or wrapping the fiberboard sheet 40 around itself. Single face 46 fiberboard sheet 40 with a fluted medium 85 is used to configure the core 20 in this particular embodiment. The open ends 73 of the flutes 70 define the core upper surface 26. Curved surfaces such as those at the core first end 24 and the core second end 25 at and planar surfaces such as the core first surface 22 and the core second surface 23 may be formed by winding the fiberboard sheet about itself, as illustrated. One or more wrappers 60 in tension may then be secured to the core 20 according to this embodiment to form the structural member 100.

Figure 7A:
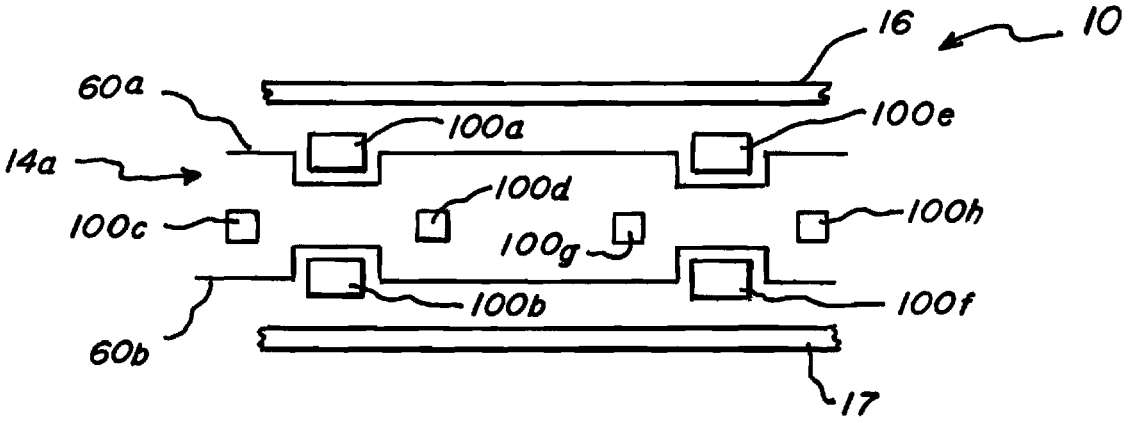
FIG. 7*a* illustrates an exploded front view of an exemplary embodiment of a shipping pallet in accordance with aspects of present invention.
Figure 7B:
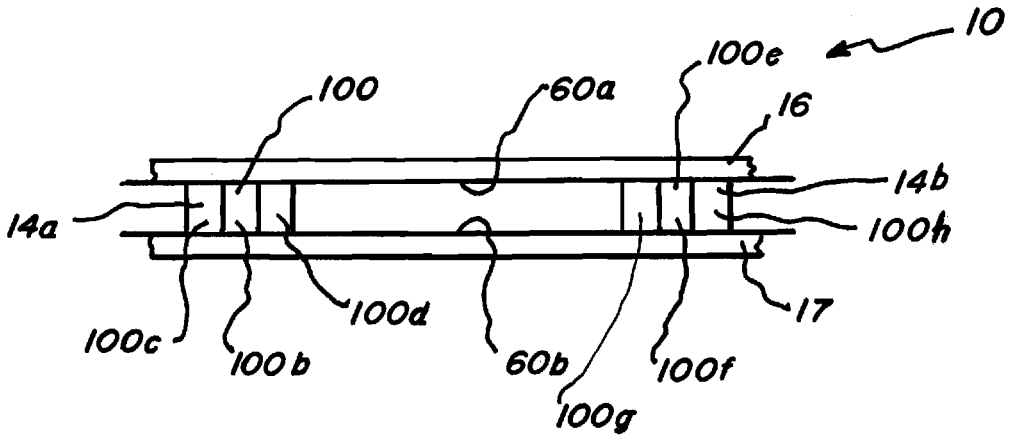
FIG. 7B illustrates a front view of an exemplary embodiment of aspects of a shipping pallet in accordance with aspects of the present invention.

FIGS. 7A and 7B illustrate a shipping pallet 10 according to aspects of the present inventions including aspects of the upper deck 16, the lower deck 17, and runners 14*a*, 14*b*. As illustrated in the exploded front view of FIG. 7A, runners 14*a*, 14*b* may be formed from several structural members 100. In this embodiment, structural members 100*a*, 100*e* are secured to the upper deck 16. A wrapper 60*a* is secured to portions of the upper deck 16 and to portions of the structural member 100*a*, 100*e*, as illustrated. The wrapper 60*a* may at least partially secure structural members 100*a*, 100*e* to the upper deck 16. Structural members 100*b*, 100*f* are secured to the lower deck 17. A wrapper 60*b* is secured to portions of the lower deck 17 and to portions of the structural member 100*a*, 100*e*, as illustrated. The wrapper 60*b* may at least partially secure structural members 100*b*, 100*f* to the lower deck 17. Wrappers 60*a*, 60*b* are interposed between the upper deck 16 and the lower deck 17 and may form a barrier between the upper deck 16 and the lower deck 17. Structural members 100*a*, 100*b* are secured to each other with wrappers 60*a*, 60*b* interposed, as illustrated and structural members 100*c*, 100*d* are secured to structural members 100*a*, 100*b* with wrappers 60*a*, 60*b* interposed to form runner 14*a*. Similarly, structural members 100*e*, 100*f* are secured to each other with wrappers 60*a*, 60*b* interposed, as illustrated and structural members 100*g*, 100*h* are secured to structural members 100*e*, 100*f* with wrappers 60*a*, 60*b* interposed to form runner 14*b*, as illustrated.

FIG. 7B illustrates a front view of a shipping pallet 10 according to aspects of the present inventions including the upper deck 16, the lower deck 17, and runners 14*a*, 14*b*. As illustrated, runner 14*a* may be a combination of structural members 100*a*, 100*b*, 100*c*, 100*d* and wrappers 60*a*, 60*b*. Wrappers 60*a*, 60*b* in combination with structural members 100*a*, 100*b* may be secured between structural members 100*c*, 100*d* compressionably as well as by adhesive or various fasteners or combinations thereof. Similarly, runner 14*b* may be a combination of structural members 100*e*, 100*f*, 100*g*, 100*h* and wrappers 60*a*, 60*b*. Wrappers 60*a*, 60*b* in combination with structural members 100*e*, 100*f* may be secured between structural members 100*g*, 100*h* compressionably as well as by adhesive or various fasteners or combinations thereof.

The present inventions also provide methods for forming a shipping pallet 10 predominantly from paper and paper products. The method includes providing one or more fiberboard sheets 40 and a wrapper 50. A core 20 is then formed from the one or more fiberboard sheets 40 by laminating the one or more fiberboard sheets 40. A tension $T_f$ is then applied to the wrapper 60 and the wrapper 60 is secured to at least portions of the core 20 while under tension to form a structural member 100. In some methods, tensions $T_f$ may be applied to several wrappers 60 and the wrappers 60 are then secured to various portions of the core 20 while subjected to the tensions $T_f$ Multiple tensions $T_f$ having an orthogonal orientation with respect to each other may be applied to a wrapper 60 or wrappers 60 and the wrapper 60 or wrappers 60 secured under tension to the core 20. The resulting structural member 100 is then used to form at least a portion of the shipping pallet 20.

The foregoing discussion discloses and describes merely exemplary embodiments of the present inventions. Upon review of the specification, one skilled in the art will readily recognize from such discussion, and from the accompanying figures and claims, that various changes, modifications and variations can be made therein without departing from the spirit and scope of the invention as defined in the following claims.

The invention claimed is:

1. A shipping pallet, comprising:

two or more runners, an upper deck secured to and supported by the two or more runners, the upper deck comprising two or more pre-stressed structural members, each of the pre-stressed structural members comprising:

a core consisting essentially of a recyclable cellulose-based material, the core defining at least a first core surface, a second core surface, a core lower surface, a core upper surface, a core first end, and a core second end, and the core comprising a plurality of laminated fiberboard sheets, the fiberboard sheets having at least one linerboard and at least one fluted medium with the fiberboard sheets disposed such that linerboards lie in a substantially parallel orientation with each fiberboard sheet secured in parallel to adjacent fiberboard sheets to form the core, the flutes in the fluted medium defining flute axes, at least some of the flute axes being substantially perpendicular to the core lower surface and the core upper surface, a wrapper, distinct from the core, consisting essentially of a single sheet of cellulose-based paper having a flexibility to wrap around the core, the wrapper wrapped around the core over each of the first core surface, the second core surface, the core lower surface, and the core upper surface, an adhesive positioned between the wrapper and at least one of the core lower surface and the core upper surface, the adhesive substantially positioned between at least the core first end and the core second end, the adhesive in contact with the wrapper to secure the wrapper in tension to the core between at least the core first end and the core second end, and the tension in the wrapper comprising a longitudinal tension, the longitudinal tension is oriented along the longitudinal direction of the pre-stressed structural member, whereby the longitudinal tension in the wrapper transmits forces to the core by the adhesive to induce compressive stress in the core in the longitudinal direction and the tension in the wrapper in combination with the compressive stress in the core pre-stresses the pre-stressed structural member, and, whereby the use of a cellulose-based material for the core and a cellulose-based paper for the wrapper permits the pre-stressed structural member to be recycled as a cellulose-based material.

2. The shipping pallet, as in claim 1, the wrapper further comprising a first wrapper and a second wrapper, the first wrapper and the second wrapper formed from separate sheets of paper, the first wrapper and the second wrapper comprising different papers, the first wrapper secured in tension with the adhesive to at least the core lower surface and the second wrapper secured in tension with adhesive to the core upper surface and the core lower surface, wherein the tension of the first wrapper is greater than the tension of the second wrapper.

3. The shipping pallet, as in claim 1, further comprising the adhesive covering the entirety of both the core upper surface and the core lower surface.

4. The shipping pallet, as in claim 1, the tension in the wrapper further comprising a normal tension oriented perpendicular to the core upper surface and a normal tension oriented perpendicular to the core lower surface to compress the core correspondingly between the core upper surface and the core lower surface in the pre-stressed structural member.

5. The shipping pallet, as in claim 1, the tension in the wrapper further comprising a normal tension oriented perpendicular to the core first core surface and a normal tension oriented perpendicular to the second core surface to compress the core correspondingly between the first core surface and the second core surface in the pre-stressed structural member.

6. The shipping pallet, as in claim 1, the tension in the wrapper comprising:

a normal tension oriented perpendicular to the core upper surface and a normal tension oriented perpendicular to the core lower surface to compress the core correspondingly between the core upper surface and the core lower surface in the pre-stressed structural member, and, a normal tension oriented perpendicular to the core first core surface and a normal tension oriented perpendicular to the second core surface to compress the core correspondingly between the first core surface and the second core surface in the pre-stressed structural member.

7. A shipping pallet, comprising:

two or more runners;

an upper deck secured to and supported by the two or more runners, the upper deck comprising two or more pre-stressed structural members, each of the pre-stressed structural members comprising:

a core consisting essentially of a recyclable cellulose-based material, the core defining at least a first core surface, a second core surface, a core lower surface, a core upper surface, a core first end, and a core second end, and the core comprising of a plurality of laminated fiberboard sheets, the fiberboard sheets having at least one linerboard and at least one fluted medium with the fiberboard sheets disposed such that linerboards lie in a substantially parallel orientation with each fiberboard sheet secured in parallel to adjacent fiberboard sheets to form the core, the flutes in the fluted medium defining flute axes, at least some of the flute axes being substantially perpendicular to the core lower surface and the core upper surface;

a wrapper, distinct from the core, comprising a single sheet of cellulose-based paper having a flexibility to wrap around the core, the wrapper wrapped around the core over each of the first core surface, the second core surface, the core lower surface, and the core upper surface;

an adhesive positioned between the wrapper and at least one of the core lower surface and the core upper surface, the adhesive substantially positioned between at least the core first end and the core second end, the adhesive being in contact with the wrapper to secure the wrapper in tension to the core between at least the core first end and the core second end; and the tension in the wrapper comprising a longitudinal tension, the longitudinal tension is oriented in a longitudinal direction of the pre-stressed structural member, whereby the longitudinal tension in the wrapper transmits forces to the core by the adhesive to induce compressive stress in the core in the longitudinal direction and the tension in the wrapper in combination with the compressive stress in the core pre-stresses the pre-stressed structural member, and, whereby the use of a cellulose-based material for the core and a cellulose-based paper for the wrapper permits the pre-stressed structural member to be recycled as a cellulose-based material.

* * * * *